United States Patent [19]

Kardos et al.

[11] 3,966,565

[45] June 29, 1976

[54] ELECTRODEPOSITION OF COPPER

[75] Inventors: Otto Kardos, Ferndale; Donald A. Arcilesi, Mount Clemens; Silvester P. Valayil, Pontiac, all of Mich.

[73] Assignee: M & T Chemicals Inc., Greenwich, Conn.

[22] Filed: Nov. 21, 1974

[21] Appl. No.: 525,717

Related U.S. Application Data

[63] Continuation-in-part of Ser. No. 315,112, Dec. 14, 1972, abandoned.

[52] U.S. Cl. ..... 204/52 R

[51] Int. Cl.[2] ..... C25D 3/38

[58] Field of Search ..... 204/52 R, 44

[56] References Cited

UNITED STATES PATENTS

| | | | |
|---|---|---|---|
| 2,849,351 | 8/1958 | Gündel et al. | 204/44 |
| 2,849,352 | 8/1958 | Kirstahler et al. | 204/44 |
| 3,000,800 | 9/1961 | Strauss et al. | 204/52 R |
| 3,023,150 | 2/1962 | Willmund et al. | 204/44 |
| 3,081,240 | 3/1963 | Strauss et al. | 204/52 R |
| 3,267,010 | 8/1966 | Creutz et al. | 204/52 R |
| 3,328,273 | 6/1967 | Creutz et al. | 204/52 R |
| 3,542,655 | 11/1970 | Kardos et al. | 204/52 R |
| 3,650,915 | 3/1972 | Quimby et al. | 204/52 R |
| 3,682,788 | 8/1972 | Kardos et al. | 204/52 R |
| 3,732,151 | 5/1973 | Abbott | 204/52 R |

member independently selected from each of the following two groups:

A. an aryl amine exhibiting the formula

*Primary Examiner*—G. L. Kaplan
*Attorney, Agent, or Firm*—Kenneth G. Wheeless; Robert P. Auber; Robert Spector

[57] ABSTRACT

This invention relates to novel compositions and to a process for electrodepositing copper from an aqueous acidic copper plating bath containing at least one

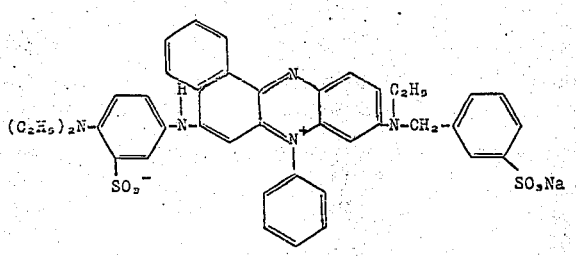

B. sulfoalkyl sulfide compounds containing the grouping —S—AlK—$SO_3M$ where M is one gram-equivalent of a cation and —Alk— is a divalent aliphatic hydrocarbon group of 1 to 8 carbon atoms.

6 Claims, No Drawings

ELECTRODEPOSITION OF COPPER

This application is a continuation in part of U.S. patent application Ser. No. 315,112 filed Dec. 14, 1972, now abandoned.

This invention relates to novel compositions and to a process for electrodepositing copper from an aqueous acidic copper plating bath containing at least one member from each of the following two groups:

A. an aryl amine exhibiting the formula:

DETAILED DESCRIPTION

Practice of this invention results in copper deposits which, depending on bath composition and operating conditions, are very suitable for rotogravure applications, or for the plating of printed circuit boards, or for electroforming, or are fully bright and strongly leveling for decorative purposes. These advantages are realized by addition of at least one member of each of the following two groups:

A. An aryl amine exhibiting the formula:

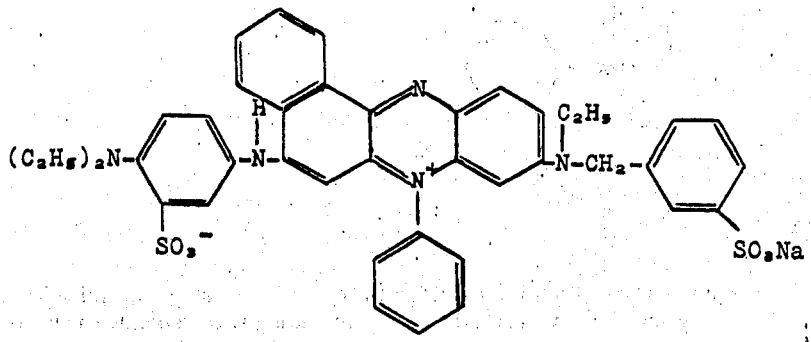

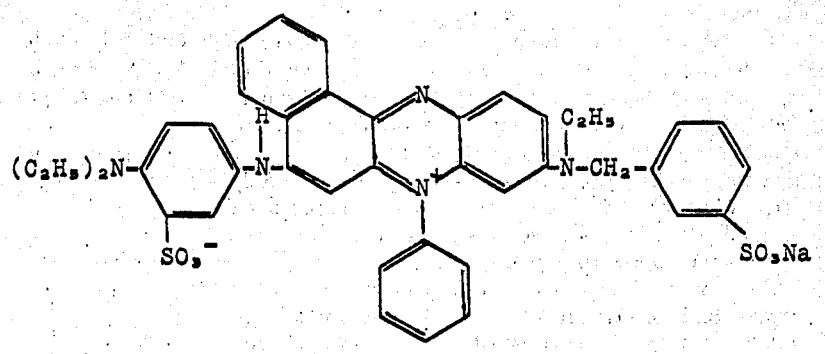

B. sulfoalkyl sulfide compounds containing the grouping —S—Alk—$SO_3M$ where M is one gram-equivalent of a cation and —Alk—is a divalent aliphatic hydrocarbon group of 1 to 8 carbon atoms.

It is an object of this invention to obtain smooth, high-speed copper electrodeposits for rotogravure applications, especially deposits possessing a relatively high permanent hardness. It is another object to obtain smooth, ductile copper deposits of high throwing power for the plating of printed circuit boards. Another object is to obtain relatively thick, smooth, ductile, low-stressed copper deposits. A further object is to obtain strongly leveled, almost bright to bright copper deposits, which require the presence of a leveling agent in addition to the presence of at least one member of each of the two groups (A) and (B).

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms which may be saturated or unsaturated, which may or may not carry substituents such as hydroxyl, alkyl, hydroxyalkyl groups, and in which the carbon chain may be interrupted by heteroatoms.

To obtain strongly leveling copper deposits, and often also to obtain fully bright copper deposits over a wide current density range, further addition of at least one member of the group of leveling agents that is diffusion controlled inhibitors, (Group (C)) is required.

Simultaneous presence of at least one member of each group (A) and (B) in the acid copper bath produces superior copper electrodeposits to those obtained when only members of one group are present in respect to one or more of the following properties: greater smoothness, greater brightness, greater hardness, or greater softness and ductility, and/or better response to the addition of a leveling agent.

Thus, this invention consists in the cooperative or synergistic action of at least two groups of addition agents:

A. an aryl amine exhibiting the formula:

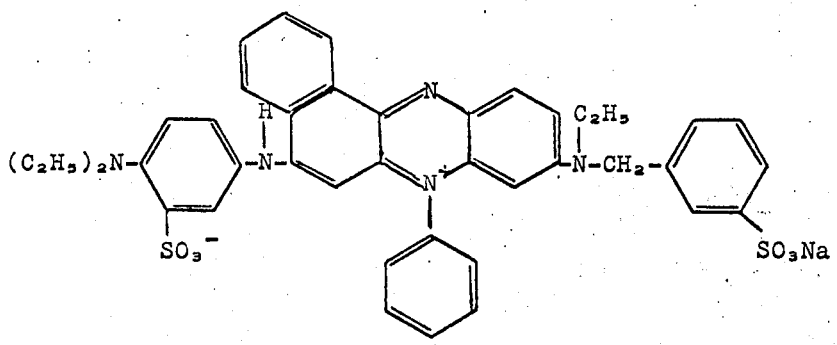

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms.

and in the case of strongly leveling copper deposits in the cooperative action of at least three groups of addition agents, namely (A), (B) and leveling agents (Group (C)).

Besides members of the two groups (A) and (B) or of the three groups (A), (B) and (C) other addition agents may be present and impart a cooperative (synergistic) effect, especially aldehyde-naphthalene sulfonic acid condensation products and polyethers.

In many cases, especially when strongly leveling fully bright copper deposits are to be obtained, the presence of small amounts of halide ions, especially chloride ions, in the copper bath is necessary.

The amines of this invention may be present in the copper bath of this invention in effective amounts of 0.005 grams per liter to 40 grams per liter of total aqueous bath composition.

The cooperating sulfoalkylsulfides exhibit the formula:

$$RS - Alk - SO_3M$$

where M denotes one gram-equivalent of a cation and — Alk — is a divalent aliphatic group of 1–8 carbon atoms; — Alk — may be a saturated or unsatured divalent aliphatic hydrocarbon group, which may or may not carry inert substituents such as hydroxyl, alkyl, hydroxyalkyl, and alkoxy in which the carbon chain may be interrupted by heteroatoms. Typical examples of — Alk — are:

$-(CH_2)_m-(CH_2)_m$ where m is 1 to 8

$-CH_2\,CHOH\,CH_2-$ , $-CH_2\,CH(CH_2OH)-$ , $-CH_2CH_2CH(CH_3)-$ , $-C(CH_3)_2-CH_2-CH(CH_3)-$ ,

-continued $-CH_2\,CH{=}CH\,CH_2-$ , $-CH_2\,C\equiv C\,CH_2-$ , $-CH_2\,CH_2\,O\,CH_2\,CH_2-$ .

In the compound R—S—Alk—$SO_3M$ R may be a hydrocarbon radical preferably selected from the group consisting of alkyl, alkenyl, alkynyl, cycloalkyl, aryl, aralkyl, alkaryl, including such radicals when inertly substituted such as preferably sulfoalkyl. R may be a sulfide or polysulfide containing up to four bivalent sulfur atoms of these hydrocarbon radicals, such as Alk $S_n^-$ and $MO_3S$—Alk—$S_n^-$, where n = 1 to 4; or it may be a sulfoalkylthioalkyl group such as $MO_3S$—Alk—S—Alk—.

R may be hydrogen or a metal cation or their sulfides and polysulfides $MS_n^-$. It may be a sulfonic group $MO_3S$— (e.g. in the reaction product of sodium thiosulfate and 1,3-propanesultone), $MO_3S\,Alk\,S\,C(=S)-$, $(Alkyl)_2\,N\,C(=S)-$, $Alkyl\,O\,C(=S)-$, an aminoiminomethyl (formamidine) group $(HN{=})(H_2N)C-$, a 1,1-dioxytetrahydrothienyl (sulfolanyl) group

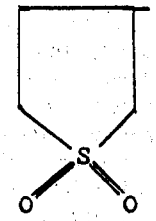

or a heterocyclic ring which may be substituted by other sulfoalkylsulfide groups, etc.

The sulfoalkylsulfides may be employed in effective amounts of 0.01 mg/l to 1000 mg/l of total aqueous bath composition. Typical sulfoalkylsulfides which may be employed according to this invention include the following compounds which are summarized in Table II.

TABLE II

COOPERATING SULFOALKYL SULFIDES (SAS) OF THE FORMULA RS—ALK—$SO_3$ M

| SAS No. | R | Alk | M |
|---|---|---|---|
| 1 | $NaO_3S(CH_2)_3S$ | $-(CH_2)_3-$ | Na |
| 2 | $NaO_3S(CH_2)_3SS$ | $-(CH_2)_3-$ | Na |
| 3 | $NaO_3S(CH_2)_4S$ | $-(CH_2)_4-$ | Na |
| 4 | $C_6H_5S$ | $-(CH_2)_3-$ | Na |
| 5 | 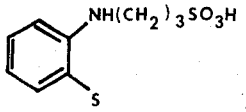 | $-(CH_2)_3$ | Na |
| 6 | H | $-(CH_2)_2-$ | Na |
| 7 | H | $-(CH_2)_3-$ | Na |
| 8 | $NaO_3S$ | $-(CH_2)_3-$ | Na |
| 9 | $NaO_3S(CH_2)_3SC(=S)$ | $-(CH_2)_3-$ | Na |
| 10 | $(C_2H_5)_2NC(=S)$ | $-(CH_2)_3-$ | Na |
| 11 | $C_2H_5OC(=S)$ | $-(CH_2)_3-$ | K |
| 12 | $NaO_3S(CH_2)_3$ | $-(CH_2)_3-$ | Na |
| 13 | $NaO_3S(CH_2)_3S(CH_2)_3$ | $-(CH_2)_3-$ | Na |
| 14 | $NaO_3S(CH_2)_3S(CH_2)_6$ | $-(CH_2)_3-$ | Na |
| 15 | $C_6H_5$ | $-(CH_2)_3-$ | Na |
| 16 | $C_6H_5CH_2$ | $-(CH_2)_3-$ | Na |
| 17 | $HN=C(NH_2)$ | $-(CH_2)_3-$ | Na |
| 18 | $NaO_3SCH_2CHOHCH_2S$ | $-CH_2CHOHCH_2-$ | Na |
| 19 | 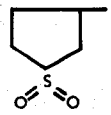 | $-(CH_2)_3-$ | Na |
| 20 | 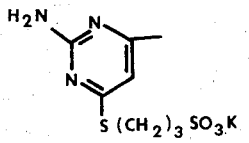 | $-(CH_2)_3$ | K |
| 21 | 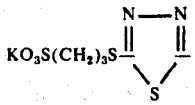 | $-(CH_2)_3-$ | K |

Another aspect of this invention is the one of obtaining strongly leveled copper deposits, that is, copper deposits which are substantially smoother than the substrate on which they are deposited. In order to possess leveling properties the acid copper plating bath must contain besides at least one member of each of the groups (A) and (B) also at least one member of group (C) comprising the leveling agents, i.e. diffusion controlled inhibitors, which may be present in an amount of at least 0.1 milligrams per liter.

Besides producing leveling the leveling agent frequently also increases brightness, and widens the bright current density range. It may also prevent roughness formation at high current density and increase hardness.

An acid copper bath containing at least one additive from each of the two groups (A) and (B) responds much better to the addition of a leveling agent than a copper bath containing only members of one of the two groups or no members of these two groups.

Leveling agents which cooperate very well with addition agents of groups (A) and (B) are those containing

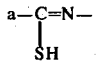

group or its tautomeric form

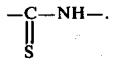

These tautomeric groups may be a part of a noncyclic molecule, such as an open thiourea in which they become a part of the wider groups

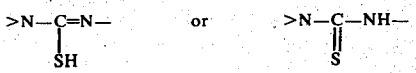

or they may be a part of heterocyclic rings where they may become a part of the wider groups

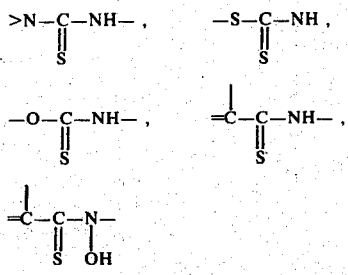

and/or their corresponding tautomeric forms.

Typical leveling agents of the open thiourea type operable in the practice of this invention are set forth in Table III of U.S. Pat. No. 3,682,788 which issued Aug. 8, 1972, upon the application of O. Kardos et al., e.g., thiourea, N-ethylthiourea(1-ethylthiourea), N,N'-diethylthiourea (1,3-diethylthiourea), N-phenylthiourea(1-phenylthiourea), etc.

Typical leveling agents of the heterocyclic type are set forth in Table III of U.S. Pat. No. 3,542,655 which issued Nov. 24, 1970, upon the application of O. Kardos et al., e.g., 2-thiazolidinethione (2-mercaptothiazoline), 2-imidazolidinethione(ethylenethiourea) and its N-hydroxyethyl derivative, 2-pyrimidinethiol(2-mercaptopyrimidine) and in Table III of U.S. patent application Ser. No. 264,193 of O. Kardos et al., filed June 19, 1972, e.g. 2-mercaptopyridine, 2-mercaptoquinoline, their N-oxides, and other derivatives in which the -SH group is replaced by

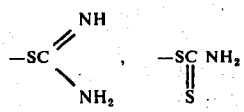

and similar groups. Also levelers which instead of the group

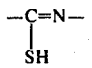

contain the corresponding mercury compound

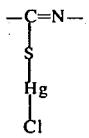

cooperate very well with the Amine plus Sulfoalkylsulfide combination.

A different type of cooperating leveling and brightening agent comprises relatively high-molecular cations such as basic phenazine azo dyestuffs like Janus Green B (diethylphenosafranine azo dimethylaniline, color Index No. 11050) or Janus Black (diethylphenosafranine azo phenol, C. I. Basic Black 2, Color Index No. 11825), and certain cationic polymers such as the polyalkyleneimines and the polymers and copolymers of 2-vinylpyridine and/or 2-methyl-5-vinylpyridine and their quaternization products with alkyl halides, benzyl halides, or 1,3-propanesultone. Simultaneous use of at least one member of each of these two types of leveling agents, together with at least one member of each group (A) and (B), results in beneficial effects as compared with those obtained with levelers of only one type, in respect to the degree and the current density range of brightness and leveling.

Another type of compounds which often exerts beneficial effects on the copper electrodeposit when used in conjunction with at least one compound of each of the two groups (A) and (B), or of each of the three groups (A), (B) and (C) are the condensation products of an aldehyde, especially formaldehyde, with naphthalene sulfonic acids, such as methylene bis-(2-naphthalene sulfonic acid) or higher molecular condensation products of this type in which, for instance, three, or, more generally, n, naphthalene sulfonic acid groups are linked by two, or, more generally, n-1, methylene groups. Addition of such compounds, e.g. of 0.6 or 2.0 g/l of the sodium salt of methylene bis-(2-naphthalene sulfonic acid) often increases the brightness and high current density smoothness of copper deposits as compared with deposits obtained from copper baths containing only members of groups (A) and (B), or only members of groups (A), (B) and (C), as shown in Examples 5, 6, 7, 8, and 10.

Still another type of compounds which often exerts beneficial effects when used in conjunction with compounds of the two groups (A) and (B), or with compounds of the three groups (A), (B) and (C) are the polyethers, especially those of rather high molecular weight. As dilute concentrations as 0.001 g/l to 0.005 g/l of a polyethyleneglycol of a molecular weight of 1000 or 6000 or 20,000, or of a nonylphenol condensate with 100 moles ethylene oxide, or of a block polymer of 80% ethylene oxide and 20% propylene oxide and approximate molecular weight 9000, considerably increase leveling, especially in the low current density area, and often also increases brightness and bright current density range (See examples 1, 2, 8 and 20).

The polyether additives may be employed in amounts of 0.005 to 1 gram per liter.

The novel compositions of the invention may be employed in combination with aqueous acidic copper plating baths. Typical aqueous acidic copper plating baths which may be employed in combination with the novel additive compositions of this invention include the following:

| | | | |
|---|---|---|---|
| | SULFATE BATH | | |
| (1) | $CuSO_4.5H_2O$ | 30–300 | g/l |
| | $H_2SO_4$ | 10–250 | g/l |
| | $Cl^-$ | 0–150 | mg/l |
| | FLUOBORATE BATH | | |
| (2) | $Cu(BF_4)_2$ | 50–600 | g/l |
| | $HBF_4$ | 1–300 | g/l |
| | $H_3BO_3$ | 0–30 | g/l |
| | $Cl^-$ | 0–150 | mg/l |

For the deposition of bright, leveling copper about 220 g/l of $CuSO_4.5H_2O$ or $Cu(BF_4)_2$, about 60 g/l of $H_2SO_4$ or 3.5 g/l of $HBF_4$, and about 20 to 80 mg/l of chloride ion are preferred. For high-speed plating, e.g., the plating of printing rolls, higher concentrations of the free acids and/or of the copper fluoborate are often preferred. For the plating of printed circuit boards, which requires high throwing power, low metal and high acid concentrations are most suitable.

The plating conditions for electrodeposition from the aforementioned baths may, for example, include temperatures of 10°–60°C. (preferably 20°–40°C.); pH (electrometric) of less than about 2.5; and a cathode current density of 0.1–50.0 amperes per square decimeter (asd).

The substrates which may be electroplated in accordance with the process of this invention may include ferrous metals, such as steel, iron, etc., bearing a surface layer of nickel or cyanide copper; zinc and its alloys including zinc-base die-cast articles bearing a surface layer of cyanide copper or pyrophosphate copper; nickel, nickel alloys with other metals such as cobalt; aluminum, including its alloys, after suitable pretreatment; and non-conducting materials, e.g., plastics, after suitable pretreatment, etc.

The following examples are set forth for the purpose of providing those skilled-in-the-art with a better understanding of this invention, and the invention is not to be construed as limited to such examples.

The plating experiments reported in the following examples were performed — unless otherwise stated — in a Hull Cell containing 250 ml of acid copper sulfate bath. The Hull Cell allows one to observe the appearance of the deposit over a wide current density range. In order to judge the degree of leveling the polished brass panels used for these plating tests were scratched with 4/0 emery polishing paper over a horizontal band of about 10 mm. width. The plating temperature used in these experiments was the ambient room temperature (24°–30°C.) unless otherwise stated. The total current was 2 amperes and the plating time 10 minutes. Air agitation was used in all cases. The amines used are listed in Table I, the sulfoalkylsulfides in Table II.

Two types of acid sulfate copper baths were used in these experiments:

| | | | |
|---|---|---|---|
| (Type 1. | Regular Sulfate Copper containing | | |
| | $CuSO_4.5H_2O$ | 220 | g/l |
| | $H_2SO_4$ | 60 | g/l |
| | Chloride ion | 0.06 | g/l |
| and Type 2.) | High-Throw Sulfate Copper containing | | |
| | $CuSO_4.5H_2O$ | 100 | g/l |
| | $H_2SO_4$ | 200 | g/l |
| | Chloride ion | 0.06 | g/l |

The chloride concentrations indicated above are those after addition of the various additives as some amines of Table I contain chloride.

The hardness values given in the various examples refer to microhardness obtained with a diamond pyramid indenter under a load of 50 grams ($DPH_{50}$) on copper deposits about 0.025 mm. thick.

EXAMPLE I

In an acid copper bath of Type 1, addition of 0.1 g/l of Amine (A) produced a rather uniform matte copper deposit. Further addition of 0.001 g/l of Sulfoalkylsulfide No. 1 ($C_3$a semi-bright copper electrodeposit over almost the whole current density range of the Hull Cell panel, and increase of the concentration of Sulfoalkylsulfide No. 1 to 0.01 g/l gave an almost bright copper plate from about 1.2 amp./sq.dm. upwards. When at this higher sulfoalkylsulfide concentration 0.0015 g/l of N-ethylthiourea were added brightness increased and considerable leveling was observed from about 1.6 amp./sq.dm. upwards. Final addition of 0.001 g/l of a polyether of the approximate formula $HO(C_3H_6O)_{15}(C_2H_4O)_{165}(CH_6O)_{15}H$ further improved brightness and leveling and increased the current density range over which fully bright and strongly leveling deposits were obtained.

While the invention has been described and illustrated in detail, it is clearly to be understood that this is intended to be of example only and is not to be taken to be of limitation, the spirit and scope of the invention being limited only by the terms of the following claims.

We claim:

1. A process for electrodepositing copper from an aqueous acidic copper plating bath containing at least one member independently selected from each of the following two groups:

A. 0.005 to 40 grams per liter of an aryl amine exhibiting the formula:

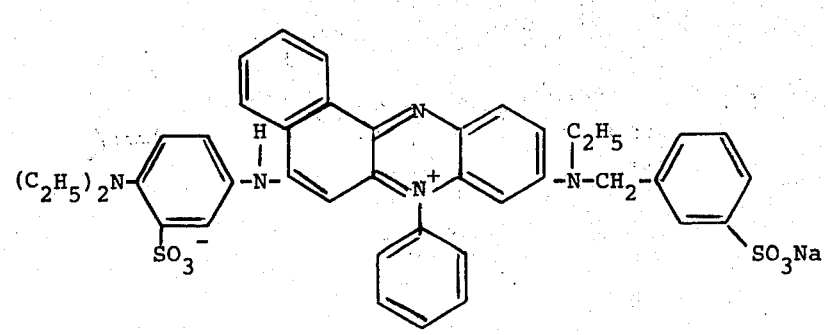

and

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms in an amount of 0.01 milligrams per liter to 1000 milligrams per liter.

2. A process for electrodepositing copper from an aqueous acidic copper plating both containing at least one member independently selected from each of the following four groups:

A. 0.005 to 40 grams per liter of an aryl amine exhibiting the formula:

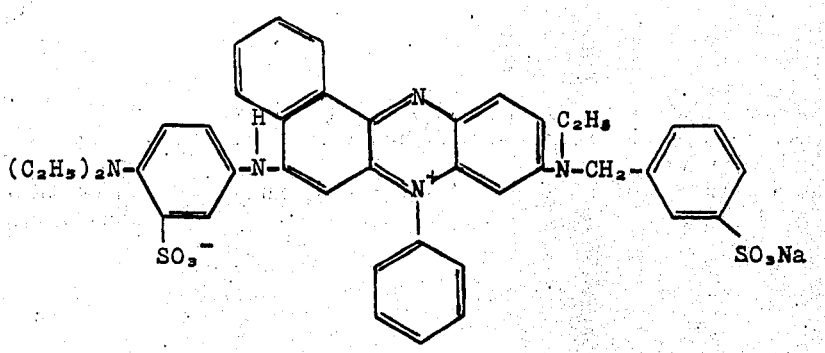

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms in an amount of 0.01 milligrams per liter to 1000 milligrams per liter;

C. diffusion controlled inhibitors which act as leveling agents which contain at least one group

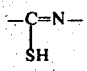

or its tautomer

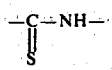

in an amount of at least 0.1 milligrams per liter; and a cationic organic compound of a molecular weight greater than about 500 selected from the group consisting of phenazine azo dyes, polyethyleneimines, alkylated polyethyleneimines, polyvinylpyridine, polyvinylalkylpyridines, and their quaternization products.

3. A process for electrodepositing copper from an

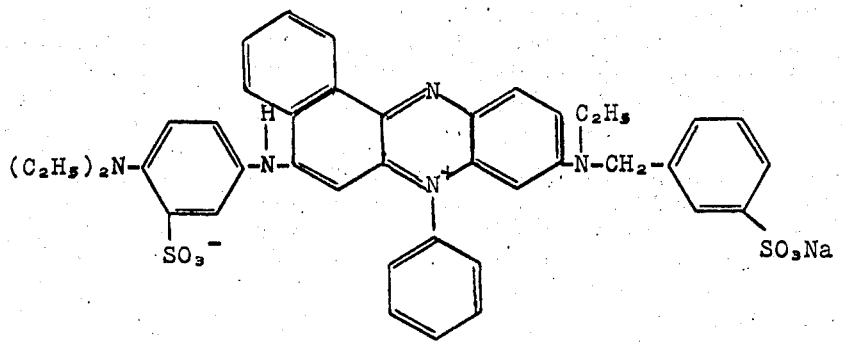

aqueous acidic copper plating bath containing at least one member independently selected from each of the following three groups:

A. 0.005 to 40 grams per liter of an aryl amine exhibiting the formula:

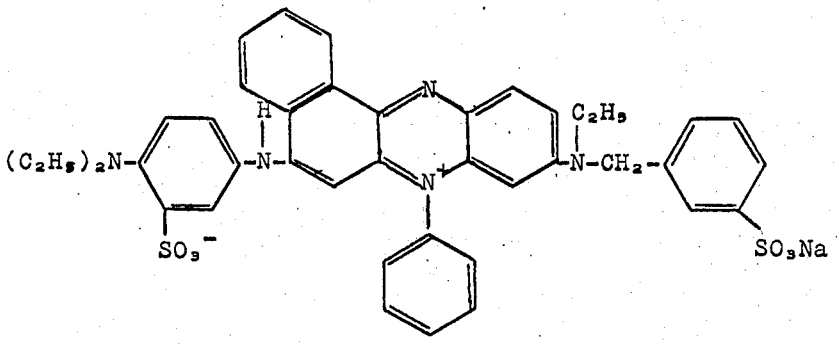

Alk—B. sulfoalkyl sulfide compounds containing the grouping —S—ALK—$SO_3M$ where M is one gram-equivalent of a cation and —Alk— is a divalent aliphatic hydrocarbon group of 1 to 8 carbon atoms in an amount of 0.01 milligrams per liter to 1000 milligrams per liter; and C. 0.06 to 5.0 grams per liter of condensation products of formaldehyde and naphthalene sulfonic acids.

4. An aqueous acidic copper electroplating bath containing at least one member independently selected from each of the following two groups:

A. 0.005 to 40 grams per liter of an aryl amine exhibiting the formula:

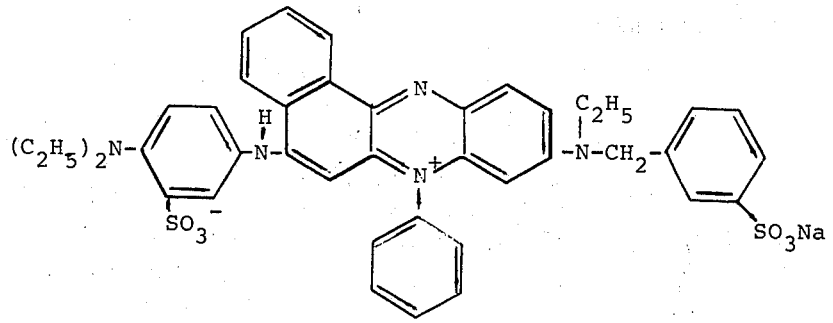

and

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms in an amount of 0.01 milligrams per liter to 1000 milligrams per liter.

5. An aqueous acidic copper electroplating bath as claimed in claim 4 wherein the cooperating sulfoalkyl-sulfide is a disulfide carrying at least one sulfoalkyl group.

6. An aqueous acidic copper electroplating bath containing at least one member independently selected from each of the following four groups:

A. 0.005 to 40 grams per liter of an aryl amine exhibiting the formula:

B. sulfoalkyl sulfide compounds containing the grouping —S—Alk—$SO_3M$ where M is one gram-equivalent of a cation and —Alk— is a divalent aliphatic hydrocarbon group of 1 to 8 carbon atoms in an amount of 0.01 milligrams per liter to 1000 milligrams per liter;

C. diffusion controlled inhibitors which act as leveling agents which contain at least one group

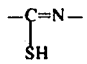

or its tautomer

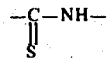

in an amount of at least 0.1 milligram per liter and

D. a cationic organic compound of a molecular weight greater than about 500 selected from the group consisting of phenazine azo dyes, polyethyleneimines, alkylated polyethyleneimines, polyvinylpyridine, polyvinylalkylpyridines, and their quaternization products.

* * * * *